United States Patent [19]

Daniel

[11] Patent Number: 4,996,794

[45] Date of Patent: Mar. 5, 1991

[54] ARTICULATION FITTINGS FOR WINDOW CASINGS OPENING ACCORDING TO THE ITALIAN ART

[75] Inventor: Vigreux Daniel, Biberkirch, France

[73] Assignee: Ferco International Usine de Ferrures de Batiment S.A.R.L., Sarrebourg, France

[21] Appl. No.: 376,034

[22] Filed: Jul. 6, 1989

[30] Foreign Application Priority Data

Jul. 12, 1988 [FR] France ..... 88 09658

[51] Int. Cl.[5] ..... E05D 15/30

[52] U.S. Cl. ..... 49/250; 49/249

[58] Field of Search ..... 49/250, 252, 249, 248, 49/246

[56] References Cited

U.S. PATENT DOCUMENTS

| | | | |
|---|---|---|---|
| 2,797,917 | 7/1957 | Lickteig, Jr. et al. | 49/249 |
| 3,101,135 | 8/1963 | Neal et al. | 49/250 X |
| 3,936,978 | 2/1976 | Barras | 49/249 X |
| 4,616,443 | 10/1986 | Araki et al. | 49/252 |

FOREIGN PATENT DOCUMENTS

| | | | |
|---|---|---|---|
| 82975 | 3/1935 | Sweden | 49/252 |
| 157866 | 1/1933 | Switzerland | 49/248 |
| 541337 | 11/1945 | United Kingdom | 49/248 |

*Primary Examiner*—Philip C. Kannan

*Attorney, Agent, or Firm*—Sandler, Greenblum & Bernstein

[57] ABSTRACT

Articulation fittings for window casings which partially covers the dormant casing and openings according to Italian art include lower compass arms and upper articulation members which cause the top rail of the window casing to project from the dormant casing during window opening movement. To detach immediately the top rail of the window casing from the dormant casing and thus avoid a premature wear and tear of the sealing joints adhering to the window casing, the articulation fittings are provided with means, which at the very beginning of the opening movement, cause the window casing to follow a path having a vertical component while causing the top rail of the window casing to follow a path having a horizontal component.

14 Claims, 6 Drawing Sheets

ARTICULATION FITTINGS FOR WINDOW CASINGS OPENING ACCORDING TO THE ITALIAN ART

BACKGROUND OF THE INVENTION,

1. FIELD OF THE INVENTION

This invention generally relates to window fittings, with specific reference being to articulation fittings for window casings or the like which partially cover the dormant casing and opening according to the Italian art. These fittings including lower compass arms and upper articulation elements adapted, in the open position, to move the top rail of the window casing away from the dormant casing.

This invention is especially to the field of house hardware.

2. DESCRIPTION OF BACKGROUND MATERIAL

It is already known to use articulation fittings for window casings opening according to the Italian art so that when in the open position the top rail of the window casing projects somewhat from the dormant casing surface.

Specifically, these known articulation fittings include a pair of compass arms disposed on either side of the window casing and connected at their upper ends to the intermediate portion of the side stiles of the window casing, and at their lower end to the side jambs and to pivot means disposed, near the lower corner of the dormant casing.

Moreover, these known articulation fittings comprise upper articulated members, notably a ramp keeper secured to the upper portion of the side jambs of the dormant casing. In rolling engagement with the interior of this keeper is a roller mounted on a link having its ends pivotally mounted with one end pivotably mounted to the window casing and the other end to a connecting member slidably engaged in a slide-bar secured to the dormant casing.

More particularly, the ramp keeper consists of a curvilinear groove formed in the connecting member and concentric to the axis of rotation of the link. This curvilinear groove opens at its upper end into an elongated vertical aperture extending towards the upper portion of the dormant casing.

These known articulation fittings operate as follows:

at the beginning of the opening movement, the rigid compass arms cause the window casing to rotate about the pivot means connecting the window casing to the upper links, beyond a sufficient angular movement, the window casing is moved upwards along a path having a vertical component, the rollers of the links corresponding to the upper articulation members being caused to slide downwards in the elongated aperture formed in the ramp keeper, and by amplifying the opening of the window casing, the above-mentioned rollers are caused to move in the curvilinear groove of said ramp keepers, thus causing the links to rotate about the pivot means connecting them to said connecting means and, eventually, the upper portion of the window casing projects outwardly from the dormant casing.

This outward projection of the window casing is necessary when the articulated fittings are fitted in fillisters of the door or window. In fact, under these conditions, the fictitious axis of rotation of the window casing is necessarily disposed on this side of its top rail. Thus, if a suitable device is not provided, this top rail of the window casing will co-operate during the opening movement with the fillister of the head jamb of the dormant casing, thus limiting or preventing the rotation of the window frame.

Though these features already exist in prior art articulation fittings, these fittings are applicable to window casings covering partially the dormant casing only at the expenses of various inconveniences. In fact, to permit the rotation of the movable casing at the beginning of its opening movement the covering lap at the periphery of this casing must be spaced a sufficient distance from the outer surface of the dormant casing. However, this distance requirement cannot be met without compromising the weather tightness of the door or window. To palliate this inconvenience, compressible joints, seals or gaskets may be provided for compensating any variations in the gap existing between said peripheral covering lap and the outer surface of the dormant casing.

As a matter of fact, this compressible joint constitutes but a partial solution of the problem, for its efficiency decreases rapidly in actual use.

More particularly, as mentioned hereinabove, when opening the window the top rail of the window casing is first caused to pivot and then moved vertically upwards before following a path having a horizontal component. In parallel thereto, the joint or weather strip is compressed and then caused to slide along the top rail of the dormant casing before moving away therefrom.

Obviously, the repeated frictional movements imparted to the joint after its compression are rather detrimental to its useful life. Now the stresses thus exerted on the joint are amplified considerably during the closing movement of the movable or window casing. In fact, the top rail of this casing is initially compressed against the dormant casing, before being moved vertically therealong. Simultaneously, the end portions of this joint cooperate with the jambs of the dormant casing and then strike the head jamb before undergoing a compressive force, instantaneously, when clearing the sharp edge formed by the lower and outer surfaces of this head jamb.

It is also obvious that the constant stress exerted on the joint will rapidly impair its efficiency.

SUMMARY OF THE INVENTION

It is the primary object of the present invention to avoid the inconveniences set forth hereinabove by providing articulation fittings for top-hung windows adapted to project from the dormant casing in their open position, and more particularly wherein the top rail of the window casing projects somewhat outside the dormant casing, with the arrangement being such that the weather strip or joint is subjected only to the stress for which it is intended; namely, a compressive force.

For this purpose, the invention provides articulation fittings for window casings of the type covering partially the dormant casing, the fittings comprising lower compass arms and upper hinge and articulated means adapted to cause the top rail of the window casing to project, in the open position, outside the dormant casing. The articulation fittings including means for causing the window casing at the very beginning of the opening movement, to follow a path having a vertical component while impressing to the top rail thereof a movement having a horizontal component.

The advantageous feature obtained with the present invention lies essentially in the fact that a minimum angle of rotation of the window casing is attended by the movement of the top rail thereof away from the dormant casing. This angle of rotation may correspond to the simple release, in the lower portion, of the peripheral joint or weather strip as a consequence of the release of the locking means. As a result, of course, the useful life of the joint is considerably increased and the window operation is greatly facilitated by the reduced frictional contacts between the window casing and the dormant casing.

The invention will now be described in detail with reference to the attached drawings illustrating preferred forms of embodiment thereof.

THE DRAWINGS

FIGS. 9, 10 and 14–16 illustrate in different views the component elements of the upper articulation fitting illustrated in FIGS. 7 and 8;

FIGS. 11, 12 and 13 are different views showing the support member secured to the dormant frame and adapted to cooperate with the upper articulation member illustrated in FIGS. 7 and 8;

DESCRIPTION OF THE PREFERRED EMBODIMENTS

Figure 1:
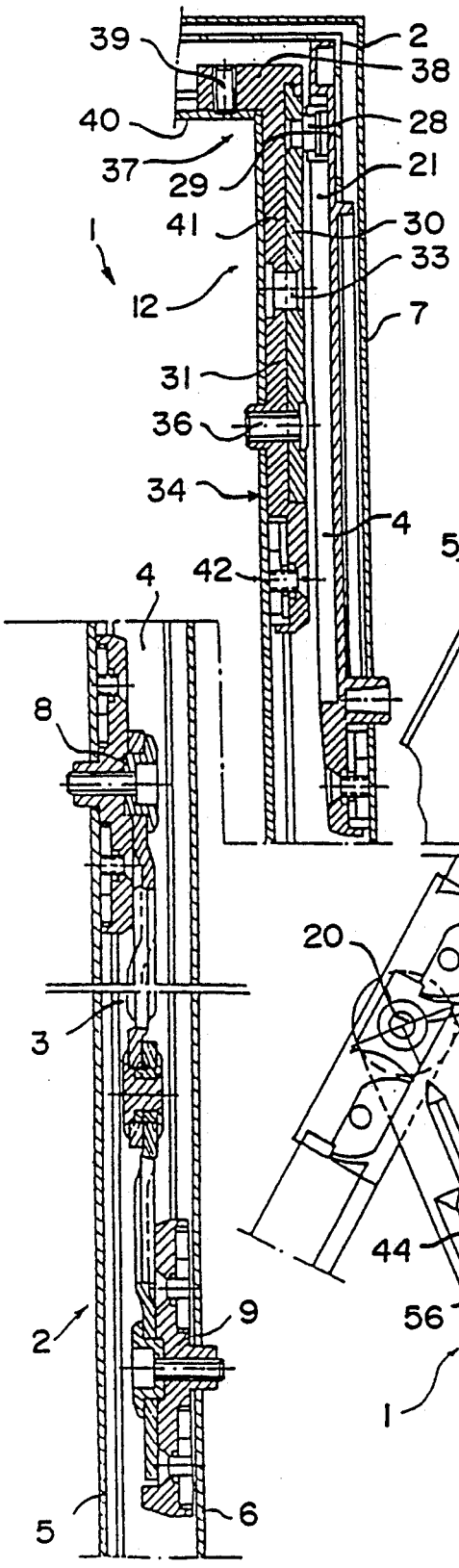
FIG. 1 is a diagrammatic elevational and sectional view of the articulation fittings according to a first embodiment of the invention.

Referring to the drawings, the articulation fittings 1 according to the present invention is intended for supporting and controlling the movements of a leaf frame 2, such as a door or window casing, opening according to the so-called Italian art. Thus, the articulation fittings 1 as illustrated in FIGS. 1, 2, 5, 6 and 21 comprise lower compass arms 3 embedded in the fillisters 4 of the stiles and jambs 5, 6 of window casing 2 and dormant casing 7.

More particularly, a lower compass arm 3 is connected via pivot means 8, 9 substantially to the intermediate portion of a stile 5 of window casing 2 and to the adjacent jamb 6 of dormant casing 7. This pivotal connection between the lower compass arm 3 and the dormant casing 7 is preferably located in the vicinity of the lower corners 10, 11 of the casing.

The purpose of these lower compass arms 3 is to cause the outward pivotal movement of the window casing 2 while causing this casing to follow a path having a vertical component. Furthermore, the lower compass arms 3 are adapted to hold the window casing 2 in an ajar position in which it forms a variable angle with respect to the dormant casing 7.

The articulation fittings 1 are completed by upper articulation means 12 adapted to connect the window casing 2 to the jambs 6 of dormant frame ,7 at the level of stiles 5 and close to the top rail 13 of the window-casing. Thus, the upper articulation means 12 facilitate the rotation of casing 2 about a horizontal axis while following this casing 2 during its vertical movement controlled by the lower compass arms 3.

The upper articulation means 12 are furthermore adapted to cause the window casing 2 to project outside the dormant casing 7 so that its head jamb 13 will not interfere with the opening of the window, or the like.

Figures 17, 18, 19, 20, 21:
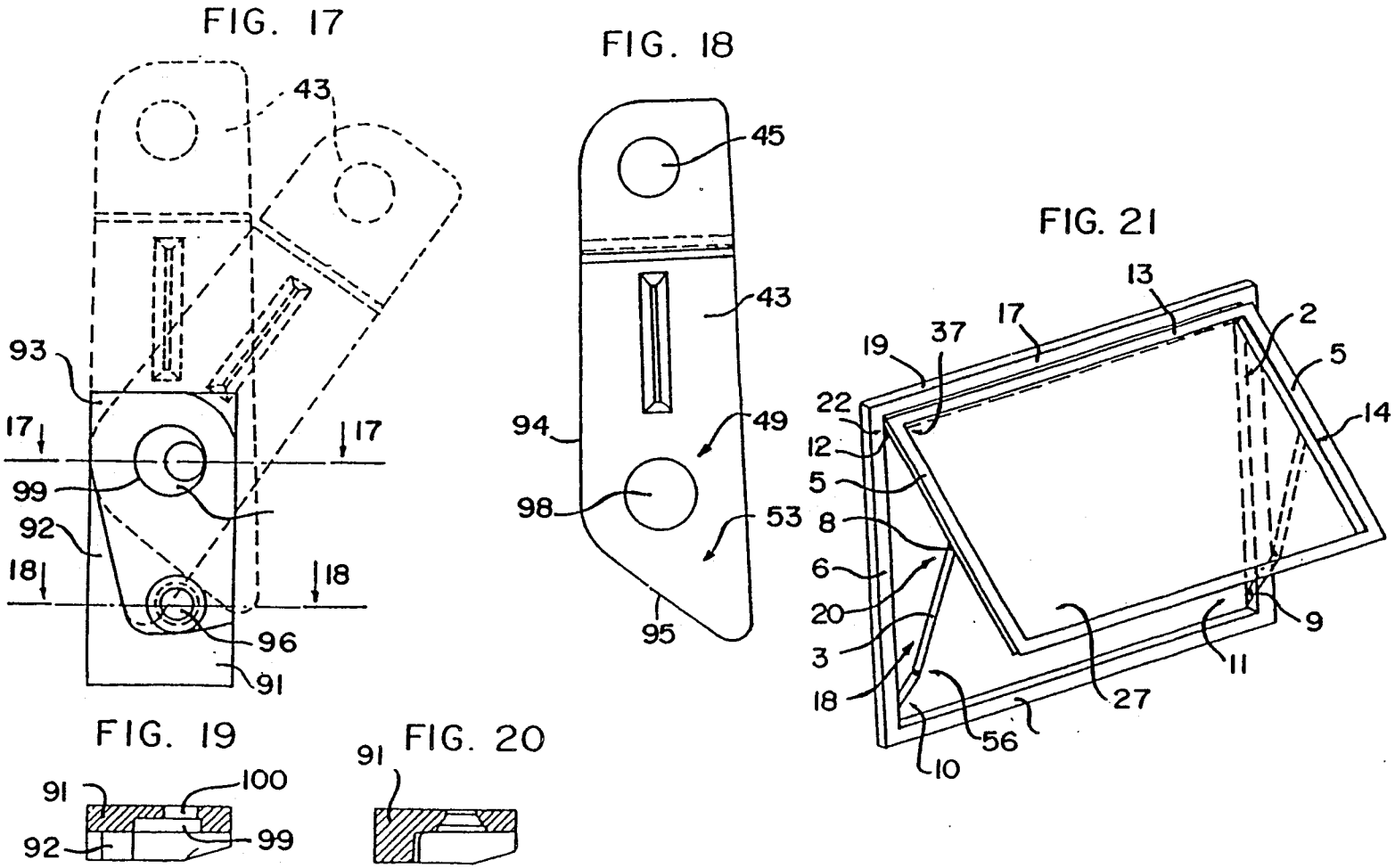
FIGS. 17–20 illustrate a second embodiment of the articulation means interconnecting the lower compass arms and the stile of the dormant casing of the window.
FIG. 21 illustrates diagrammatically in perspective view a window opening according to the Italian art, provided with the articulation fittings of the present invention.

This outward projection of window casing 2 is advantageous especially when the casing 2 is intended for partially covering the dormant casing 7, as illustrated in FIG. 21. In this case, the opening casing 2 is provided along its periphery 14 with an overlapping lip 15 having a joint or weather strip 16 adapted, in the closed position, to engage the inner face 17 of the dormant casing 7.

However, this outward projection of casing 2 is really efficient only if it takes place at the very beginning of the window opening movement, so that the peripheral joint 16 will not be stressed by the upward vertical movement of the window casing 2. For this purpose and according to a specific feature characterizing the present invention, the articulation fittings 1 are provided with means 18 adapted, at the very beginning of the window opening movement, to impress thereto a movement having a vertical component while moving the top rail thereof in a horizontal direction.

In fact, these means 18 comprise on the one hand the lower compass arms 3 permitting, beyond an opening angle as small as possible, the collapse by gravity of the opening casing 2 with respect to the dormant casing 7. This collapse is attended simultaneously with the release of the top rail 13 of casing 2 with respect to the head jamb 19 of dormant casing 7 by virtue of specific upper articulation means 12.

To sum up, said means 18 are such that the axis 20 of the pivotal movements of the lower compass arms 3 on casing 2 follow a path of which the derivative tends to infinity during the closing movement, this derivative being zero in the case of known, non-articulated compass arms.

Furthermore, according to a first embodiment illustrated in FIGS. 1–4, the upper articulation means 12 consist of a ramp keeper 21 embedded in the side jamb 6 of dormant casing 7, at the upper corner 22 thereof. This ramp keeper 21 has formed therein an oblique groove 23 of which the upper portion 24 extends inwards and leads at its lower end 25 to a vertical groove 26 of which the length is subordinate to the maximum opening angle contemplated for the opening casing.

This oblique groove 23 or vertical groove 26 is engaged by a roller 28 mounted to the upper end 29 of a connecting member 30 cooperating with a support 31 secured in a fillister 32 of the window stile 5. The essential function of connecting member 30 is to permit the adjustment of the window casing 2 with respect to its dormant casing 7, in a direction at right angles thereto. Thus, it is possible through this connecting member 30 to determine the degree of compressive force exerted against the joint 16 when closing the window.

For this purpose, said connecting member 30 is pivotally mounted at 33, intermediate its ends, on said support 31 and comprises in its lower portion 34 an elongated aperture 35 permitting the passage of fastening member 36 and determining the range of permissible adjustments. Thus, by shifting angularly the connecting member 30 in relation to said support 31, after loosening the fastening member 36, it is possible to reduce or increase the gap between the opening leaf 2 and the dormant casing 7, especially at the level of the top rail 13 and head jamb 19, respectively.

The positioning of said window casing 2 in relation to dormant casing 7 in a vertical direction is provided by means of the above-mentioned support member 31 which, for this purpose, is L-shaped and covers the upper corner 38 of the movable casing 2. More particularly, the horizontal portion 38 of said support 31 comprises adjustment means 39 cooperating with the upper edge 40 of top rail 13 of the window casing 2. Thus, the vertical position of the vertical portion 41 of support 31 on stile 5 is adjustable by actuating said means 39.

Of course, other embodiment of this support 31 may be contemplated, since its specific configuration depends essentially on the structure and the materials constituting the window. By way of example, the support 31 may have a different shape according as to whether the window casing 2 and the dormant casing 7 are made of wood, metal or plastic sections.

The same applies obviously to the fastening means 42 for securing the vertical portion 41 of support 31 to the stile 5 of window casing 2. More particularly, these fastening means should be selected to avoid any machining operation when sectional elements are used.

FIGS. 1, 2, 5, 6 and 17–20 of the drawings illustrate different forms of embodiment of a lower compass arm 3 which, according to the invention, is articulated to impart a vertical movement to the window casing 2 from the very beginning of its opening movement. More particularly, FIGS. 17–20 20 show the lower section 43 of this lower compass arm 3 and the connection thereof with the dormant casing 7 by means of joint couplings 9. The joint couplings 8 interconnecting the upper section 44 and the jamb 5 of dormant frame 2 are shown more in details in FIGS. 1, 2, 5 and 6.

Stress may be laid on the fact that, to ensure a satisfactory operation of the articulation fittings 1 and warrant the desired result, it is necessary to limit the angle of rotation of the lower section 43 with respect to the upper portion 44 of said lower compass arm 3. In fact, if this angle were not limited, these portions would become useless, since they would not be capable of holding the window casing 2 ajar and imparting a sufficient degree of stability thereto. Moreover, they would be unable to assist in the opening and closing movements of the window casing 2.

For this purpose, the pivot pin 45 interconnecting the lower and upper sections 43, 44 of the lower compass arm 3 is provided with a stop member adapted to limit the angle formed between these sections. On the other hand, the articulation means 9 interconnecting the lower compass arm 3 and the dormant casing 7 are provided with stop means 46 adapted to limit the angular movement of the lower section 43 during the window opening step.

The stop means 46 not only determine the maximum angular movement of the window casing 2 but also and more particularly enable the lower compass arms 3 to act as support means. In fact, the lower compass arms 3 compensate one fraction of the load consisting of said window casing 2, which load, if not so compensated, would be supported integrally by the upper articulation means 12.

Figure 2:
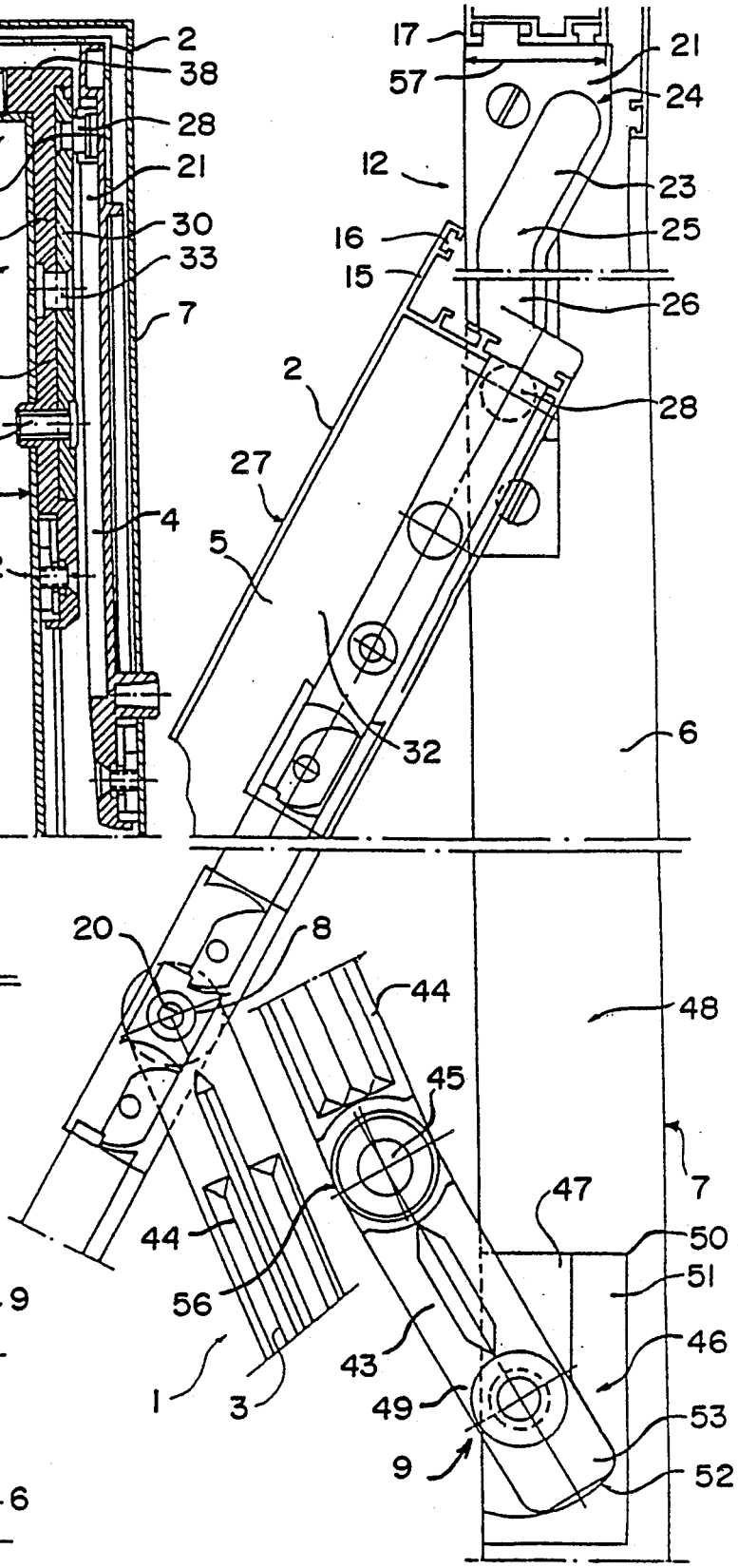
FIG. 2 is a diagrammatic side-elevational and fragmentary view of the articulation fittings of FIG. 1, the movable leaf being shown in its open position.
Figure 3:
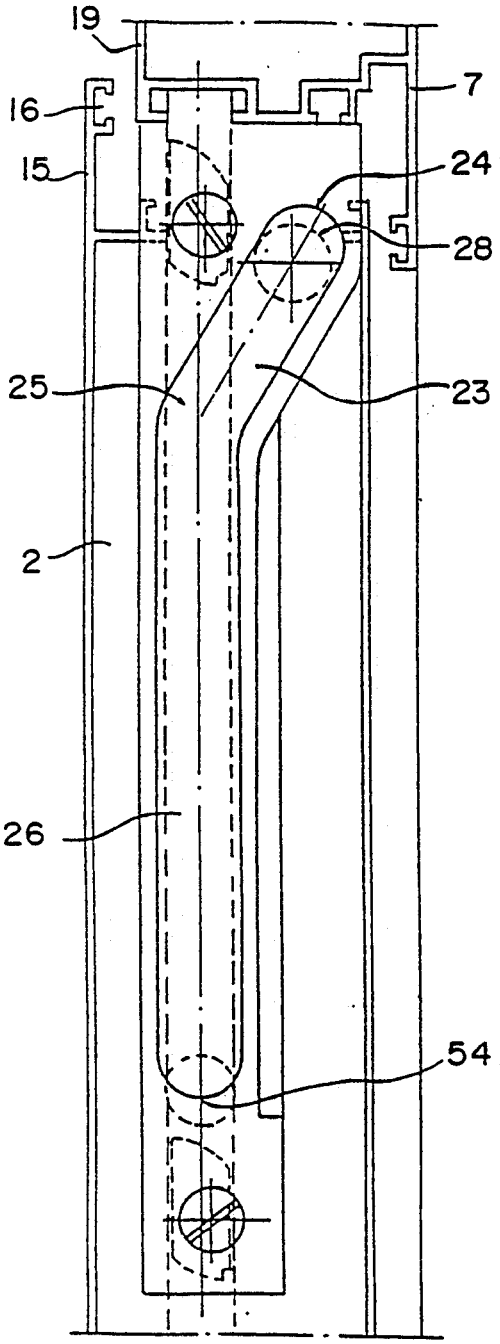
FIG. 3 is a diagrammatic view showing the keeper of an upper articulation member as illustrated in FIG. 1.
Figure 4:
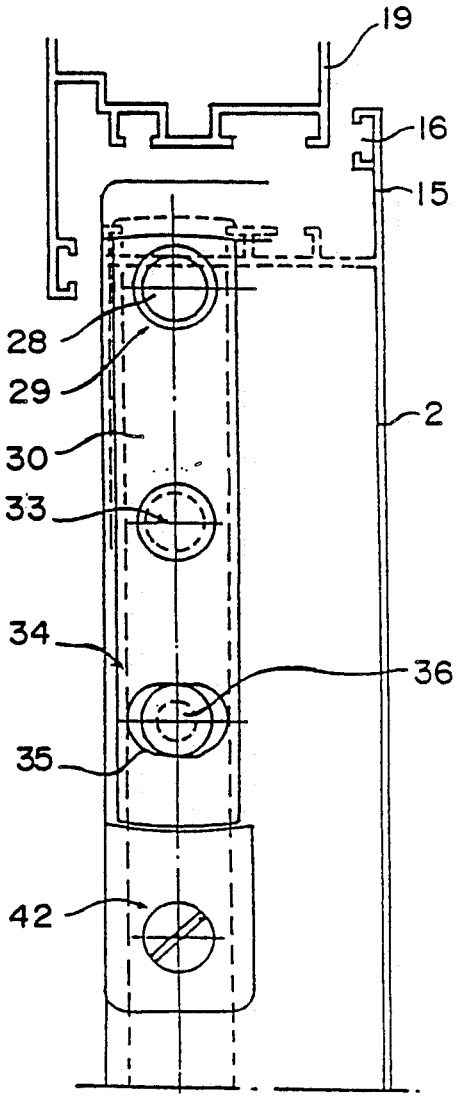
FIG. 4 is a diagrammatic view showing the fitting means attached to the window casing and engaging the ramp keeper of FIG. 3.
Figure 5:
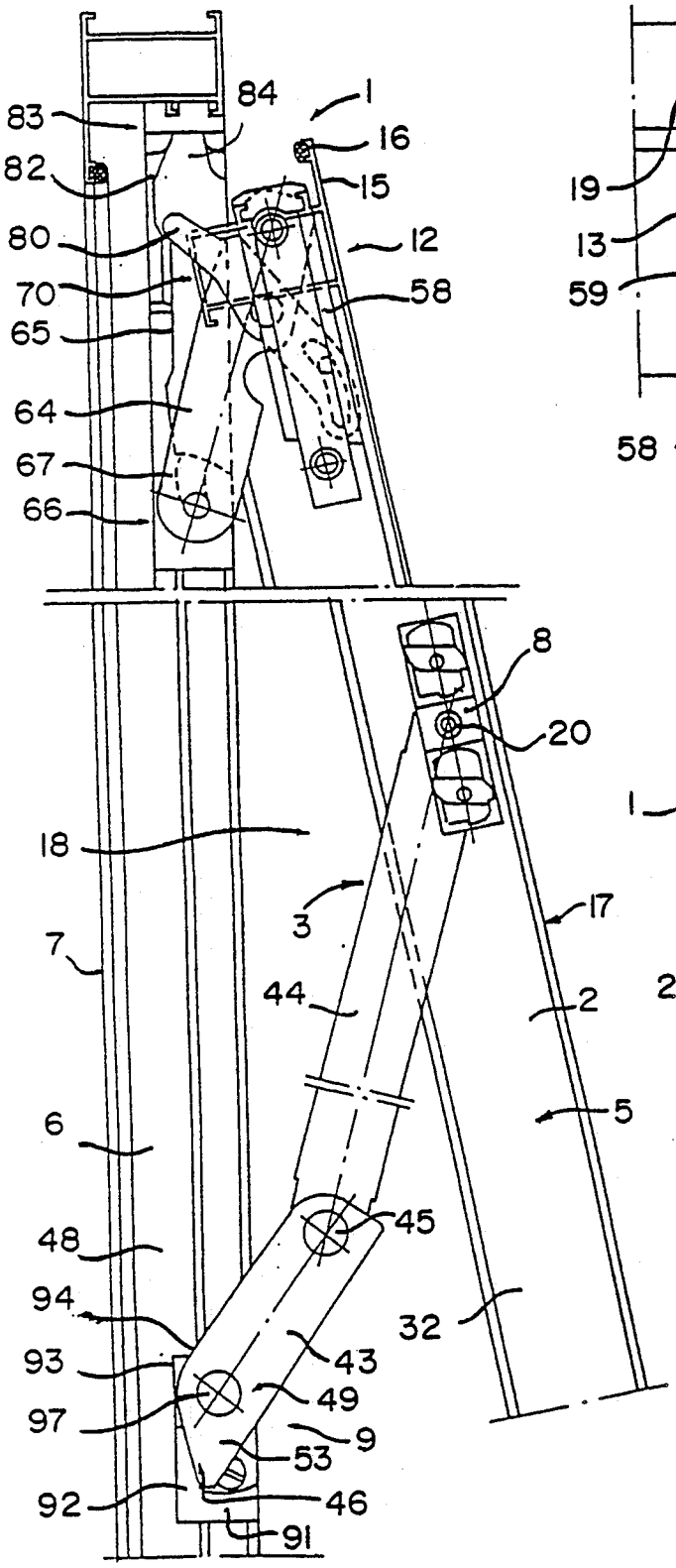
FIG. 5 is a diagrammatic side elevational view showing the articulation fittings corresponding to a second embodiment of the invention, the window casing being shown in its open position.
Figure 6:
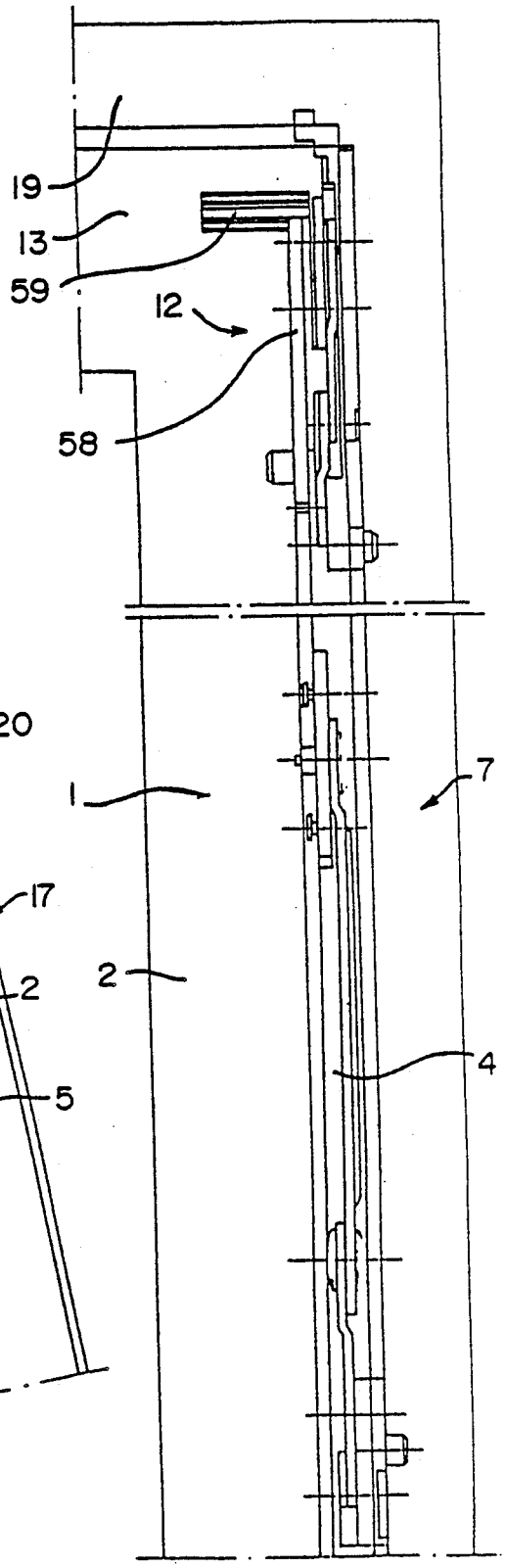
FIG. 6 is a diagrammatic elevational view of the articulation fittings, as illustrated in FIG. 5.
Figure 7:
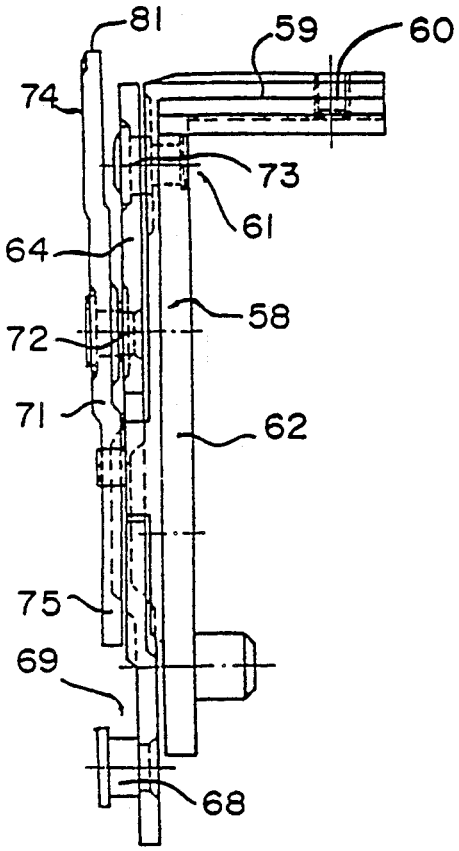
FIG. 7 is a diagrammatic elevational front view showing an upper articulation member according to the second embodiment.
Figure 8:
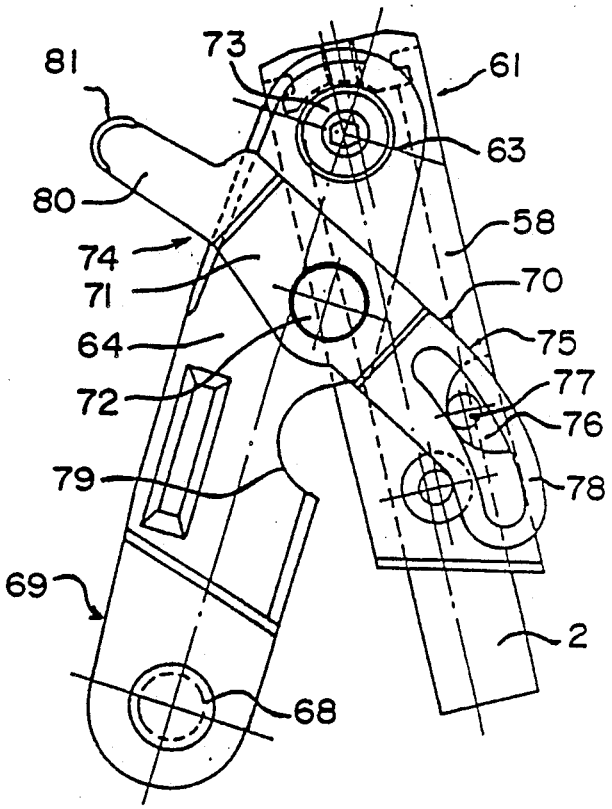
FIG. 8 is a view taken from the left side of FIG. 7.
Figure 9A:
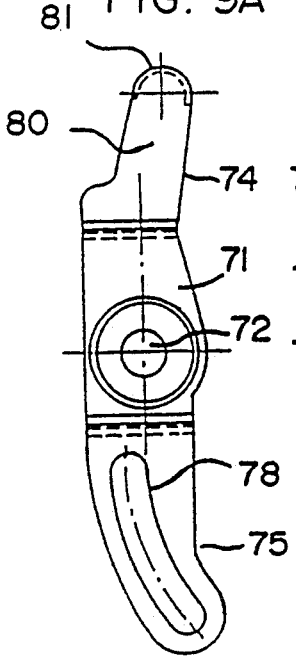
Figure 9B:
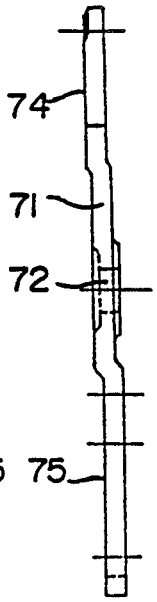
Figure 10A:
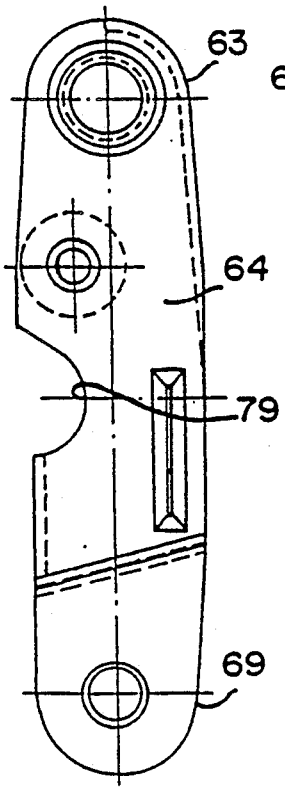
Figure 10B:
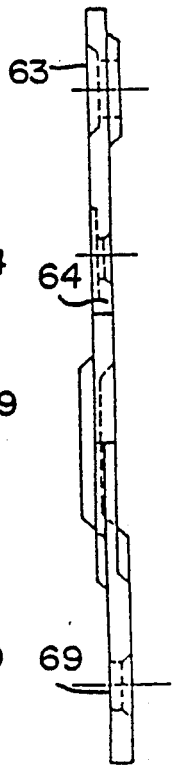
Figures 11A, 11B, 12, 13, 14A, 14B, 15, 16:
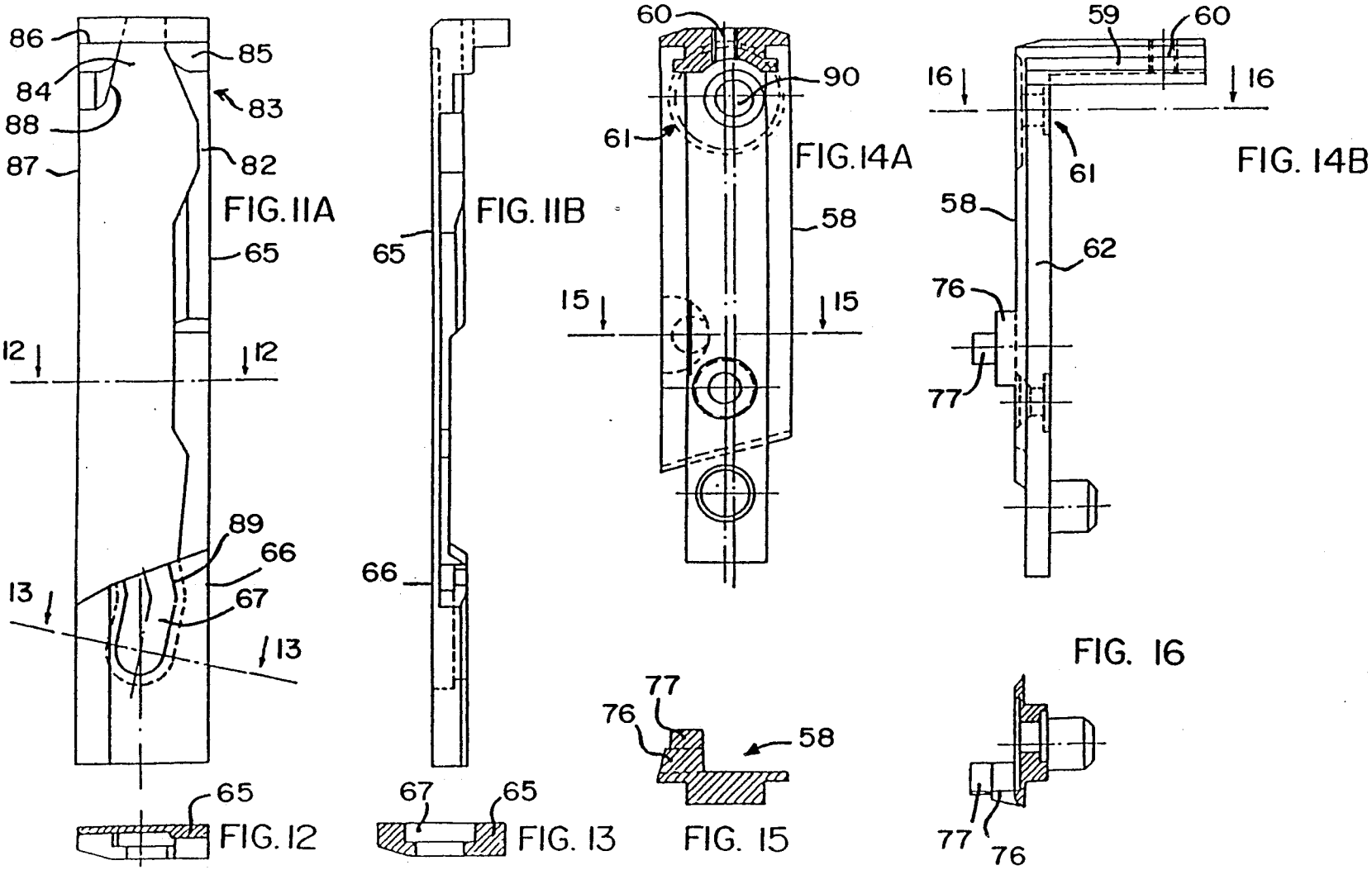

Thus, according to a first embodiment, corresponding to FIGS. 1 and 2, the articulation means 9 interconnecting the lower section 43 of a lower compass arm 3 and a side jamb 6 of dormant casing 7, comprise a support member 47 fitted in the fillister 48 of said side jamb 6 having pivotally mounted thereon the lower end 49 of said lower section 43. The support member 47 is provided on its rear vertical edge 50 with a ledge 51 having milled therein a notch 52 constituting the stop means 46. More particularly, the notch 52 is adapted, in the open position, to receive the lower end 53 of said lower section 43, thus limiting the angular movement of this section.

The articulated fittings according to the first embodiment operate as follows:

as soon as the opening movement of the window casing begins by actuating a locking fitting (not shown), the mere release of the peripheral joint 16 exerts a pressure on the window casing 2, this release being attended by a movement of roller 28 of the upper articulation 12 in the oblique groove 23; as a result, the top rail 13 of opening frame 2 is moved immediately away from the head jamb 19 of dormant casing 7;

while moving in the windw opening direction, the casing 2 begins to rotate about a horizontal axis which is the axis of rotation of rollers 28, these rollers being thus caused to slide simultaneously along the oblique groove 23 before engaging the vertical groove 26 down to the lower end 54 thereof. Then, the window casing 2 is in its maximum open position;

when the assembly is controlled in the opposite direction, the user exerts a tractive effort on the window casing 2 for closing it so that, due to the impulse produced by the lower compass arms 3, the rollers 28 corresponding to the upper compass assembly 12 will rise in the ramp keepers 21;

at the end of the locking phase, the receiving keepers (not shown in the drawings) secured in the fillisters 32 of the stiles 5 of the window casing 2 engage the knees 56 of the lower compass arms 3 so as to cause a re-alignment of the lower and upper sections 43 and 44 thereof. As a result, the opening frame 2 is moved upwards and eventually the peripheral joints 16 are compressed as a consequence of the movement of rollers 28 along the oblique grooves 23.

Though particularly efficient in operation, the articulation fittings 1 according to the first embodiment of the present invention may be objectionable on account of the relatively excessive thickness of the lateral stiles and jambs 5 and 6 fitted in the fillisters of the opening frame 2 and dormant frame 7, respectively.

In fact, the amplitude of the movement, in a horizontal direction, imparted to the window casing 2 is subordinate to the length and to the inclination to the horizontal of the oblique groove 23. Now, these parameters are subordinate in turn to the width 57 of the ramp keeper 21 and, eventually, to the width available in the fillisters 48 of the lateral stiles 6 of dormant casing 7.

However, it may happen that, due to differences in the design of the structure of a window according to the Italian art, or in certain specific cases, it is not possible due to lack of sufficient space to insert upper articulation elements 12 such as described hereinabove into the fillisters. A problem may also arise in case it is required that the opening frame 2 projects to a greater extent in front of or outside the dormant casing 7, for example on account of the greater dimensions of an overlapping lip 15.

The second embodiment of the articulation fittings 1 according to the present invention, illustrated in FIGS. 5–16 of the drawings, provides a satisfactory solution to the above-mentioned problem by providing upper articulation members 12 and articulation means 9 interconnecting the lower compass arm 3 and the dormant casing 7 which have smaller over-all dimensions and whose efficiency is not subordinate to any dimensional requirement concerning the window structure.

Thus, according to this second form of embodiment, the upper articulation means 12 comprise an L-shaped support member 58 mounted on the window casing and covering the upper corner 37 thereof, and a horizontal portion 59 provided with adjustment means 60 permitting the positioning of the window casing 2 in a vertical direction on the dormant casing 7. Pivotally mounted to the upper end 61 of the vertical portion 62 of said support 58 is one end 63 of a link 64 interconnecting said window casing 2 and said dormant casing 7. More particularly, the dormant casing 7 is provided at the upper ends of its side jambs 6 with a dormant casing support member 65 having formed in its lower portion 66 an arcuate aperture 67 engaged by a roller 68 carried by the opposite end 69 of link 64.

With this arrangement, when opening the window the collapse of the movable casing 2 is attended by the downward movement of the top rail 13 of said casing 2 in relation to the head jamb 19 of dormant casing 7.

The window casing 2 is moved to its projecting position simultaneously with the pivotal movement imparted thereto during the opening phase, this result being obtained through suitable means 70. It will be seen that the amplitude of the horizontal movement imparted to the window casing 2 is proportional to the angle of rotation imparted thereto.

For this purpose, the aforesaid means 70 consist of a secondary arm 71 pivotally mounted intermediate its ends 72 on said link 64, slightly below the pivot pin 73 interconnecting said link 64 and the window casing support member 58. In addition, this secondary arm 71 co-operates with said dormant casing support member 65 and said window casing support member 58. More particularly, the window casing support member 58 is provided with a boss 76 formed with a stud engaging an elongated aperture 78 formed through the lower end 75 of secondary arm 71. This lower end 75 has a curvilinear configuration so as to reduce the dimensions of the secondary arm 71 to be fitted in the window fillister. However, this lower end 75, like the elongated aperture 78 formed therein, may also be strictly rectilinear without impairing the proper operation of the articulation fittings 1.

Since the link 64 is interposed between the support member 58 and said secondary arm 71, the essential function of said boss 76 is to compensate the thickness of said link 64. In addition, said link 64 acts as a bearing to said secondary arm 71 and facilitates the proper operation of the upper articulation member 12. On the other hand, as a counterpart and in order to reduce the overall dimensions of this articulation member 12, the link 64 comprises a notch 79 adapted to be engaged by the boss 76 when the window is closed.

The upper end 74 of this secondary arm 71 comprises an extension 80 acting as a lever arm and engaging with its free end 81 a bearing ramp 82 formed in the dormant casing support member 65.

Due to this particular configuration of the upper articulation member 12, when opening the window, and as explained in the foregoing, the roller 68 is caused to slide along the groove 67. Then, the angular movement of the window casing 2 causes the pivotal movement of the secondary arm 71 via stud 77. The extension 80 of arm 71, by engaging the bearing ramp 82, imparts an angular movement to link 64, so as to move the window casing 2 backwards, and this link 64 causes the top rail 13 to move away from the dormant casing 7. The contour of this bearing ramp S2 will be determined as a function of the amplitude of the horizontal movement which it is desired to impart to the window casing 2. A concave configuration of this ramp B2 permits of obtaining a certain proportionality between the horizontal movement and the angle of the pivotal movement of window casing 2.

Advantageously, and according to a specific feature of the invention, the extension 80 of secondary arm 71 may act on the one hand as a means for compressing the peripheral joint 16 when closing the window and on the other hand as a means for locking the window casing 2 against its dormant casing 7.

For this purpose, the dormant casing support member 65 is provided at its upper end 83 with a keeper 84 consisting substantially of an extension 85 formed on the bearing ramp 82 and of a boss 86 formed on the side 87 opposite thereto. This keeper 84 has an outflaring aperture formed therein, which is gradually engaged by the extension 80 of secondary arm 71 during the window closing movement. When approaching the dormant casing 7, the free end 81 of said extension 80 engages more particularly the guide ramp 88 formed by the boss 86. Thus, as a consequence of the vertical movement imparted to the window casing 2, the progress of said free end 81 on said guide ramp 88, like the movement of roller 68 in aperture 67, partakes in the compression of the peripheral joint 16. During the return movement at 89 in said aperture 67, the window casing 2 is locked in this position while preventing the downward movement of roller 68.

The degree of compression of the peripheral joint 16 is determined notably in the upper portion of the window as a function of the position of the window-casing support member 58 along the side stile 5 of the window casing 2. This position is adjustable by means of an eccentric 90 or equivalent means disposed on said support member 58.

From the foregoing it is clear that this arrangement of the upper articulation member 12 reduces appreciably its over-all dimensions while affording the possibility of causing the window casing 2 to project out a sufficient distance from the dormant casing 7.

Of course, the shapes of the component elements of this upper articulation assembly 12 and notably their thickness are calculated with a view to avoid any notching or cutting whether in the side stiles 5 of window casing 2 or in the dormant casing 7.

On the other hand, the articulations interconnecting the various component elements of the system are advantageously provided with braking means affording a certain degree of flexibility in the window operation.

In the second embodiment of the articulation means 9 interconnecting the lower section 43 of the lower compass arm 3 and the side jamb 6 of dormant casing 7, said means 9 also comprise a support member 91 disposed in the fillister 48 of said jamb 6 of casing 7. The lower section 43 of compass arm 3 is pivotally mounted on said support member 91.

This support member 91 further comprises stop means 46 limiting the angular movement of the lower section 43. In this second form of embodiment said stop means 46 consist substantially of a ledge 92 formed in the rear vertical edge 93 of support 91 and engageable by the lower end 53 of said lower section 43 in the open window position. More particularly, this lower section 43 is bevelled at its lower end 53 and on its rear edge 94 so as to form an inclined edge 95 adapted to bear against the ledge 92 when the window casing 2 is open. This construction of articulation means 9 affords a substantial reduction in their over-all dimensions, irrespective of the angular position of the window casing 2. Moreover, adjustment means 96 are provided for properly positioning the support member 91 on the stile 6 of dormant casing 7, in a direction at right angles to the plane of this casing. These adjustment means 96 are necessary for determining the degree of compression exerted on the peripheral joint 16 when closing the window.

In connection therewith, the principle of the eccentric may be cited by way of example. This principle permits, by resorting to a simple rotation, of off-setting angularly the support member 91, this adjustment being transmitted to the arms of the lower compass 3 and eventually to the window casing 2.

Of course, such adjustment means 96 may also be incorporated in the first embodiment described hereinabove with reference to FIGS. 1 and 2 of the drawings.

The articulated mounting of the lower portion 49 of lower section 43 on said support member 91 comprises preferably a pivot pin 97 rigidly connected to said support 91 and extending through an aperture 98 machined in the lower end portion 49 of said lower section 43. A flange or any other equivalent means, rigidly connected to the free end of said pivot pin 97, will advantageously prevent any undesired release of the lower compass arm 3. To avoid any failure in the operation of the articulation means 9, it is necessary to properly fix this pin 97 to support member 91. For this purpose, the pivot pin 97 engages a recess 99 machined in said support member 91 and communicating with an orifice 100 permitting the passage of a fastening member such as a rivet. This recess 99 should preferably be off-set with respect to said orifice 100 to prevent, in the assembled condition, the rotation of pivot pin 97 as a consequence of the recurrent pivotal movements of said lower section 43.

What is claimed as new is:

1. Articulation fitting for a window casing which partially covers a dormant casing and which opens according to the Italian art, said articulation fitting comprising lower compass arms, with each lower compass arm including an upper section and a lower section interconnected by means for pivoting, said upper section including first means for articulation for operatively connecting said upper section to a side stile of the window casing, and said lower section including second means for articulation for operatively connecting said lower section to a side jamb of the dormant casing;

upper articulation means for causing, during an opening phase, the top rail of the window casing to project outwardly with respect to the dormant casing; and said lower compass arms and said upper articulation means being capable of cooperating to permit the window casing, at the beginning of its opening movement, to move along a path having a vertical component while imparting to the top rail a movement having a horizontal component.

2. The articulation fitting according to claim 1, wherein said second means for articulation include a first support member for fitting in fillisters formed in the side jamb, and means for limiting the angle of rotation of said lower section, and further including adjustment means for setting the position of said first support member on the side jamb of the dormant casing in a direction at right angles to the plane of the dormant casing.

3. The articulation fitting according to claim 2, wherein said first support means includes a rear vertical edge and means for stopping movement of said lower section, said means for stopping including a notch milled in a ledge formed on said rear vertical edge of said support member, said notch being engageable in the open position of the window casing by a lower end of said lower section.

4. The articulation fitting according to claim 2, wherein said support member includes a vertical edge and means for stopping movement of said lower section, said means for stopping including a ledge formed in said vertical edge of said support member and engageable by a lower end of said lower section in the open position of the window casing, said lower section being bevelled at said lower end and including a rear edge to define an inclined edge adapted to bear against said ledge.

5. The articulation fitting according to claim 1, wherein said upper articulation means include a ramp keeper adapted to be fitted in a fillister of the side jamb of the dormant casing, said ramp keeper including an oblique groove having an upper portion extending inwardly with respect to the dormant casing and leading at its lower end into a vertical groove.

6. The articulation fitting according to claim 1, wherein said an upper articulation means include a ramp keeper having an oblique groove and a vertical groove adapted to be positioned in fillisters formed in the side jamb of the dormant casing, said upper articulation means further comprising a connecting member for cooperating with a support member secured in fillisters of the side jamb of the window casing, said connecting member permitting adjustment of the window casing with respect to the dormant casing in a direction at right angles to the plane of the dormant casing and carrying at its upper end a roller slidably engaged in said oblique and vertical grooves of said ramp keeper.

7. The articulation fitting according to claim 6, wherein said connecting member is pivotally mounted intermediate its ends by means for pivoting on said support member adapted to be secured to the dormant casing, and comprising in its lower portion an elongated aperture permitting passage of a fastening member and defining the permissible range of adjustments.

8. The articulation fitting according to claim 1, wherein said upper articulation means include L-shaped support members adapted to be fitted to the window casing, and corresponding links having one end pivotally mounted to an upper end of a vertical portion of a window casing support member, the other end of said link carrying a roller engaging an arcuate aperture machined in a lower portion of a dormant casing support member adapted to be secured to the upper end of the side jamb of the dormant casing.

9. The articulation fittings of claim 8, wherein said upper articulation means further include means for causing, during the window opening movement, a gradual outward movement of the window casing in relation to the dormant casing, said means for causing gradual outward movement including a secondary arm pivotally mounted intermediate its ends to said link and capable of cooperating through its upper end and lower end with said dormant casing support member and said L-shaped support member, respectively.

10. The articulation fitting according to claim 9, wherein said lower end of said secondary arm includes an elongated aperture engaged by a stud projecting from a boss formed on said L-shaped support member, and said upper end of said secondary arm includes a lever-arm extension for engaging at its free end a bearing ramp formed on said dormant casing support member.

11. The articulation fitting according to claim 10, wherein said engaging of said lever-arm extension with said bearing ramp functions to compress the window casing against the dormant casing during the window closing movement, and to lock the window casing against the dormant casing.

12. The articulation fitting according to claim 10, wherein said dormant casing support member includes at its upper end a keeper composed substantially of an extension of said bearing ramp and of a boss disposed on the side opposite said ramp on said dormant casing support member, said keeper having an outflared aperture adapted to be gradually engaged by said extension of said secondary arm during the closing movement of the window casing.

13. The articulation fitting according to claim 1, wherein said means for pivoting connecting said upper section and said lower section form a knee joint, said knee joint being capable of cooperating, during closing movement of the window casing, with means for causing the re-alignment of said upper section and said lower section of said lower compass arms, which are positionable within fillisters formed in the stiles of the window casing.

14. The articulation fitting according to claim 1, in combination with a window casing which partially covers a dormant casing.

* * * * *